US005099579A

United States Patent [19]

Chadwick

[11] Patent Number: 5,099,579

[45] Date of Patent: Mar. 31, 1992

[54] TIRE PUNCTURING DEVICE

[76] Inventor: Thomas L. Chadwick, 8636 Encina, Fontana, Calif. 92335

[21] Appl. No.: 651,955

[22] Filed: Feb. 7, 1991

[51] Int. Cl.[5] ..... B26F 1/00; B26F 1/24; B26F 1/32

[52] U.S. Cl. ..... 30/366; 30/358; 30/364

[58] Field of Search ..... 30/364, 366, 358, 363, 30/362; 81/9.1, 9.22

[56] References Cited

U.S. PATENT DOCUMENTS

| | | | |
|---|---|---|---|
| 734,157 | 7/1903 | Bernard | 30/364 |
| 1,209,571 | 12/1916 | Fegley et al. | 30/358 |
| 1,465,793 | 8/1923 | Schilling | 30/366 |
| 2,087,186 | 7/1937 | Freeman, Jr. | 30/358 |
| 2,432,176 | 12/1947 | Schubring | 30/358 |
| 4,473,948 | 10/1984 | Chadwick | 30/366 |

*Primary Examiner*—Douglas D. Watts
*Assistant Examiner*—Paul M. Heyrana, Sr.
*Attorney, Agent, or Firm*—Harvey S. Hertz

[57] ABSTRACT

An improved tire puncturing device includes a base plate having a plurality of drive pins whose axes are formed in a plane perpendicular to the plane of the base plate. The drive pins extend from one side of the base plate and include a free end which forms a piercing point. Each of the drive pins are secured in the base plate and have an aperture formed therethrough for enabling fluid to enter the aperture at the piercing point and exit the drive pin at the other side of the base plate.

1 Claim, 1 Drawing Sheet

TIRE PUNCTURING DEVICE

BACKGROUND OF THE INVENTION

1. Field of the Invention

The invention relates in general to tire puncturing devices, and more particularly, to a plate member which can be attached to an automobile tire, deflating the tire and preventing the automobile from being driven.

2. Description of the Prior Art.

In my U.S. Pat. No. 4,473,948 there is disclosed a tire puncturing device formed of a base plate having a plurality of drive pins which extend upwardly along axes perpendicular to the plane of the base plate. The device is intended for use by a law enforcement officer. The piercing points are attached to the surface of the tire. As the tire rotates, the piercing points will penetrate the tire and cause the tire to deflate. To prevent the tire from sealing on the drive pins, the drive pins are coated with polytetrafluoroethylene, commercially available under the trademark Teflon. However, it has been found that even coating the drive pins with Teflon does not allow immediate deflation of the tire.

SUMMARY OF THE INVENTION

A tire puncturing device comprises a base plate having a plurality of drive pins whose axes are formed in a plane perpendicular to the plane of the base plate. The drive pins extend from one side of the base plate and include a free end which forms a piercing point. Each of the drive pins are secured in the base plate and have an aperture formed therethrough for enabling fluid to enter the aperture at the piercing point and exit the drive pins at the other side of the base plate.

The advantages of this invention, both as to its construction and mode of operation, will be readily appreciated as the same becomes better understood by reference to the following accompanying drawings in which like reference numerals designate like parts throughout the figures.

DESCRIPTION OF THE PREFERRED EMBODIMENT

Figure 1:
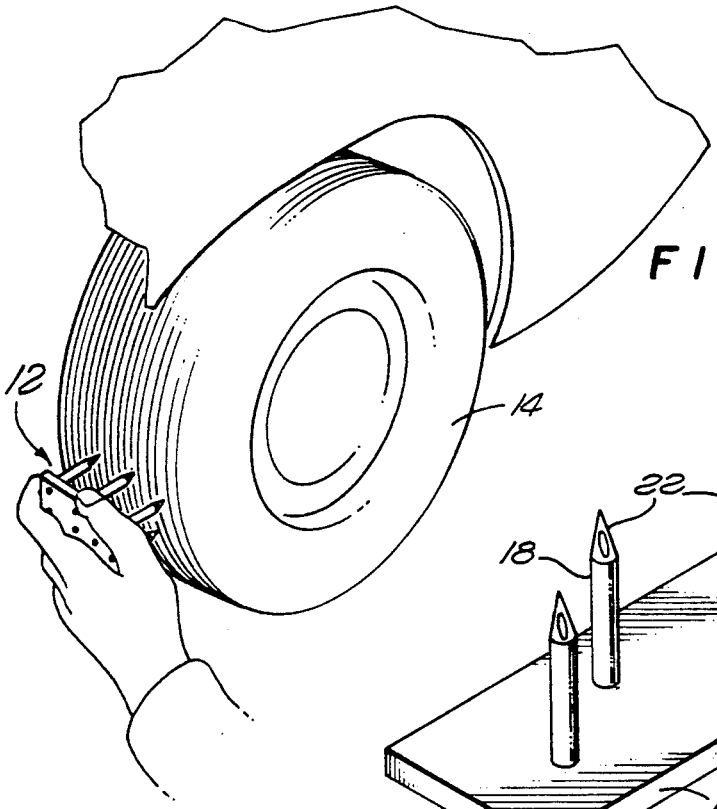
FIG. 1 is a perspective view illustrating the technique for utilizing the improved tire puncturing device

Referring now to the drawings, there are shown in FIG. 1 and improved tire puncturing device 12 being utilized to penetrate the tire 14 of a motor vehicle. Typically, the tire puncturing device includes a base plate 16 having a plurality of drive pins 18 extending therefrom. The tips of the drive pins are forced into the treads of the tires as shown in FIG. 1. As the tire 14 rotates, the drive pins will be forced further through the tire wall until the full depth of the tire wall has been penetrated. Once penetration is accomplished, air will leak from the tire and the tire and the tire will be deflated, thus disabling the vehicle.

Figure 2:
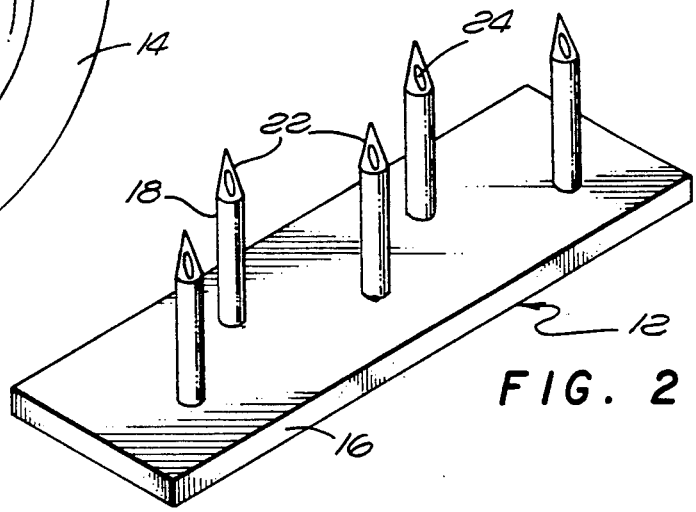
FIG. 2 is a perspective view of the improved tire puncturing device of FIG. 1.

As illustrated in FIG. 2, the tire puncturing device 12 includes the base plate 16 of generally rectangular configuration. A plurality of drive pins 18 extend from the base plate. Each of the drive pins 18 terminate at its free end in pointed pierce tip 22. The drive pins 18 are formed of a hard metal such as spring steel or chrome alloy and contain an aperture 24 which extends therethrough.

Typically, the cylindrical drive pins 18 are made of steel formed from rods which are cut to the desired length of the drive pins 18. Then, the drive pins 18 are cut at a bias at one end thereof to form the pointed pierced tip 22. Thereafter, the drive pins 18 are press fit and then welded into openings formed in the base plate 16 which is normally also made of steel. After the drive pins 18 pierce the wall of the tire and enter the interior of the tire, air in the interior of the tire will pass through the apertures 24 of the drive pins and pass out the aperture at the opposite side of the base plate.

Figure 3:
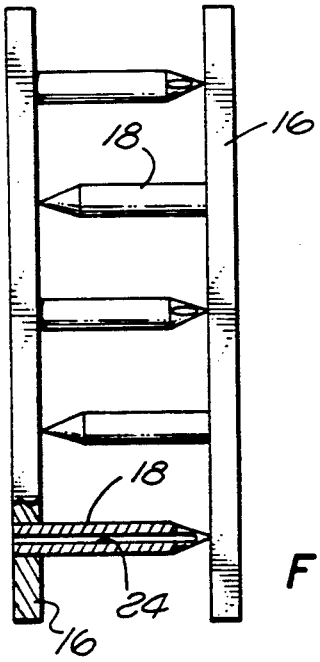
FIG. 3 is an end view, partially in section, illustrating a pair of tire puncturing devices of FIG. 2 positioned adjacent to each other.
Figure 4:
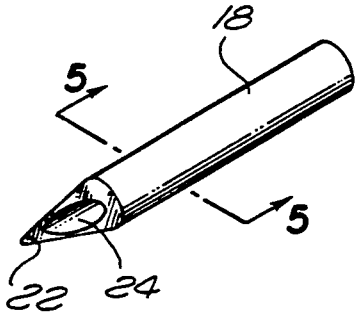
FIG. 4 is a perspective view of one of the drive pins utilized in the tire puncturing device of FIG. 2.
Figure 5:
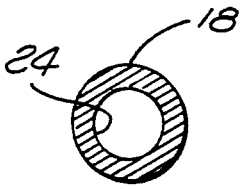
FIG. 5 is a cross-sectional view of one of the drive pins of FIG. 4 taken along the line 5—5 thereof.

FIG. 3 illustrates a pair of tire puncturing devices 12 which can be positioned with the tips of the drive pins 18 of one of the plates abutting the tips of the drive pins of the other plate. This technique is utilized to carry or mount a pair of tire punctured devices on the belt of the law enforcement officer.

It should be noted that the bottom drive pin illustrated in cross-section in FIG. 3 illustrates the passage way formed by aperture 24 which enables the air in the tire to pass through the pin and out the opposite side of the base plate 16 enabling a rapid deflation of the tire.

When used with conventional automobile tires, a conventional base plate 16 is formed of approximately 3/16 of an inch thickness. The drive pins are approximately 1 1/4 inch in length. However, should the device be used to deflate truck tires, it has been found that a longer length drive pin may be needed. Further, the drive pins could be coated with Teflon to facilitate penetration of the pins 18 into the tire wall.

I claim:

1. A tire puncturing device comprising a base plate having a plurality of drive pins whose axes are formed in a plane perpendicular to the plane of the base plate; said drive pins having a longitudinally extending axis and extending from one side of the base plate and including a free end which forms a piercing point, each of said drive pins being secured at tis other end in said base plate and having an aperture formed therethrough for enabling fluid to enter the apertures at said piercing point and exit said drive pins at the other side of said base plate, said drive pins being press fit into openings formed in said base plate, and wherein said each of said drive pin apertures extends from the piercing point of said drive pins through to the other end of said drive pins.

* * * * *